United States Patent [19]

Engel

[11] 3,991,462

[45] Nov. 16, 1976

[54] METHOD AND APPARATUS FOR PROCESSING METALLIC STRIP MATERIAL

[75] Inventor: George F. Engel, Trenton, N.J.

[73] Assignee: Stonite Coil Corporation, Yardville, N.J.

[22] Filed: Oct. 28, 1975

[21] Appl. No.: 619,271

[52] U.S. Cl. ..... 29/605; 29/403; 72/160

[51] Int. Cl.[2] ..... H01F 41/06

[58] Field of Search ..... 29/403, 401, 605–609; 72/160, 40, 183, 137

[56] References Cited

UNITED STATES PATENTS

| | | | |
|---|---|---|---|
| 2,168,435 | 8/1939 | Bond | 72/160 X |
| 2,907,151 | 10/1959 | Peterson | 51/324 |
| 3,084,425 | 4/1963 | Erskine | 29/403 |

*Primary Examiner*—Milton S. Mehr
*Attorney, Agent, or Firm*—Sperry and Zoda

[57] ABSTRACT

A method and apparatus for processing strip material including feeding a supply of unprocessed strip material from a coil thereof, passing the strip material through bending means for forming the strip material about small diameter bending angles to remove non-resilient materials from the surface thereof, stripping the sides and edges of the material by applying reversely rotating steel brushes to the sides thereof, scraping the sides and edges of the strip material by the use of abrasion surfaces such as sandpaper and the like which may be rotated in the opposite direction to the movement of the strip material through the processing equipment, apparatus for straightening the strip material by stretching and pulling it while extended about a group of rollers, and a winding station for pulling the strip material through the processing system and for rolling the processed strip material onto insulated conductor coils.

25 Claims, 2 Drawing Figures

METHOD AND APPARATUS FOR PROCESSING METALLIC STRIP MATERIAL

BACKGROUND OF THE INVENTION

1. Field of the Invention

Equipment for use in lifting and relocating very heavy metal parts often make use of extremely strong electrical magnets. These types of booms are usually operated by extensive cranes and other similar devices. Such equipment is particularly applicable to use in handling of automobiles, cargo, acrap, or any other structures which are encased in or consist of heavy metal structures.

To achieve the strong magnetic forces required in such equipment an extremely large electromagnetic device must be utilized. Hence, an electrical coil must be used which is capable of carrying large amount of current. Coils used for these purposes often are formed from metallic strip material as large as 4 to 6 inches in width with a coil diameter of 3 to 7 feet. Aluminum has proven to be the best metal for use in such coils when all factors of cost and usage are considered. The insulation between windings of the aluminum strip material has been provided by various insulating compositions which are affixed to the surfaces of the aluminum strip material during the assembly of the coil.

During operation of the electromagnetic coil, a variety of forces or contaminants cause shorts through the coil such that after a certain period of usage, the coil will be shorted to the point that it is no longer usable. Such shorts can be created by a breakdown in the composition insulating material between the coil layers or by deforming of the coil itself during the extremely heavy damaging uses to which the electromagnetic lifting device is exposed. Therefore, at some point the coil no longer becomes usable due to electrical shorts therein.

2. Description of the Prior Art

The recent great increases in the prices of raw materials such as aluminum, copper, and the like has necessitated the development of systems for salvaging materials from discarded devices. In particular, the aluminum or copper of the completely shorted electromagnetic coils is valuable and a process for recycling this aluminum into new electromagnetic coil devices is desirable.

One of the great problems of forming new coils from the aluminum strip material of shorted coils is the difficulty in the removal of the various contaminants which adhere to the surfaces of the aluminum. In particular, one of the most difficult problems is the removal of the composition insulating material which becomes very strongly secured to the aluminum surfaces during the periods of extreme heat which are generated within the aluminum during very heavy lifting operations. As more electromagnet force is required to lift heavy devices, the heat generated within the coil is increased and the composition material is essentially burned onto the surfaces of the aluminum strip material. It is often exactly this heating operation which results in the shorting of the coil itself. A great deal of money and energy could be saved if a system were developed which could simply and efficiently take the metallic strip coil material from a shorted coil and process the strip material to the point that it can be rewound in a form to be usable in an electromagnetic coil as utilized originally.

Much work has been done in the field of processing strip material such as United States Pat. No. 3,084,425 to Erskine, U.S. Pat. No. 2,907,151 issued to Peterson, and U.S. Pat. No. 2,397,029 issued to McLaughlin et al. These patents all involve processes and apparatus for working and cleaning strip material but none of these patents disclose a process which cleans, scrapes, and straightens and rewinds metallic strip material into reusable coil form as shown in the present invention.

SUMMARY OF THE INVENTION

An embodiment of the present invention includes a payoff turntable which is adapted to have located thereon a cylindrical electrical winding of metallic strip material such as aluminum and the like. The payoff table is adapted to rotate as the strip of metallic material is pulled therefrom. The payoff table can have a braking means associated therewith for increasing the frictional resistance to rotation of the payoff table. The strip material which is pulled from the payoff table can be bent about freely rotatable cylindrical bending rolls which have relatively small diameters to cause the strip material to be pulled tightly and stretched about these small diameters. In this manner any brittle, dry composition or paper materials which are affixed to the surfaces of the affixed materials will be broken therefrom. The strip material can then pass through cylindrical wire brushes abutting both surfaces of the material and rotating opposite to the direction of movement of the material itself. The strip material can also be passed between abrasion devices which utilize leaves of sandpaper or other grit bearing surfaces which contact the surfaces of the strip material and scrape undesired substances therefrom.

The metallic strip material can be passed through a bank of rollers for straightening of the material by stretching and pulling it about sharp angles with relatively high pulling force. The number of and relative orientation of the rollers within the roller group can be adjustable to vary the amount of tension and bending angles therein.

The metallic strip material can then pass to a winding turntable to be rewound in the original cylindrical coil form. The winding turntable may also include a means for the insertion of paper or other composition insulation between windings of the metallic conductor material.

The apparatus and method of the present patent thereby unwinds, cleans, resurfaces, straightens and rewinds such heavy duty electromagnetic coil devices as used in the present field of art. The strip material can be driven through the system by being pulled by the rotation of the winding turntable. This turntable can be affixed to a drive means which causes the winding turntable to rotate in the desired direction.

It is an object of the present invention to provide a method for recycling of metallic conductor material.

It is an object of the present invention to provide a method and apparatus for cleaning and resurfacing aluminum and other metallic strip of material.

It is another object of the present invention to provide a simple and inexpensive system for stretching and straightening aluminum strip material by bending it about a plurality of cylindrical rotatable rollers while under high tension.

It is an object of the present invention to provide a system for processing metallic strip material which has a variable adjustment for varying the amount of tensile and sheet forces exerted thereon to resurface and straighten the strip material.

It is an object of the present invention to provide a system for simply and efficiently recycling conductor coils from heavy duty lifting electromagnets.

It is an object of the present invention to provide a system for bending metallic strip material about narrow radii to break away from the surfaces papers or other composition material having different bending characteristics.

It is another object of the present invention to recycle aluminum electromagnetic coil conductors.

BRIEF DESCRIPTIONS OF THE DRAWINGS

While the invention is particularly pointed out and distinctly claimed in the concluding portions therein, a preferred embodiment is set forth in the following detailed description which may be best understood when read in connection with the accompanying drawings, in which:

FIG. 1 is a front elevation of an embodiment of the apparatus of the present invention; and FIG. 2 is a top plan view of the apparatus shown in FIG. 1.

DETAILED DESCRIPTION OF THE PRESENT INVENTION

Figure 1:
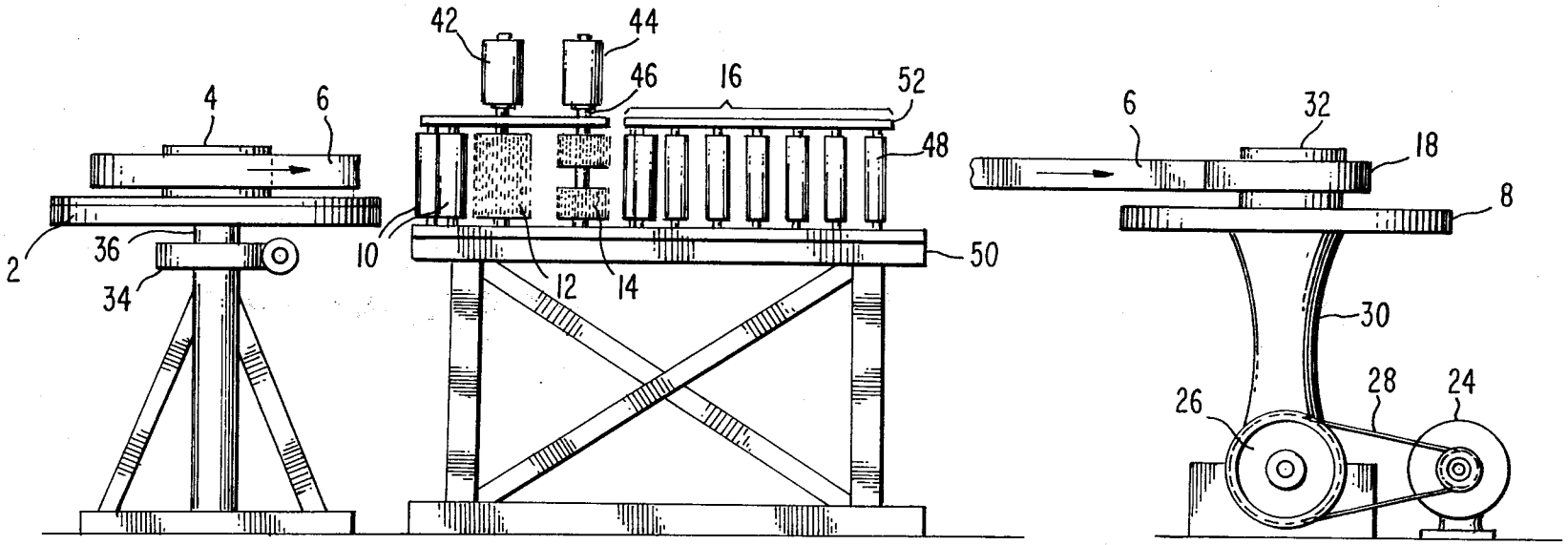

An embodiment of the present invention includes a payoff table 2 which can support thereon a rolled cylindrical coil 4 of metallic strip material such as aluminum conductor stripping, generally designated as 6. Roll 4 can be an electromagnetic generating device which has been shorted due to extensive uses such that the coil windings are no longer insulated with respect to one another and strong magnetic fields are not capable of generation when current is sent flowing through material 6. In this respect, it is necessary to strip, clean, straighten and rewind this roll 4 to facilitate reuse. The material 6 can be pulled through the processing apparatus by the winding turntable 8 which is positioned at the end of the processing line to rewind the material 6 for reuse. As material 6 is pulled from coil 4 on payoff table 2, it passes through several processing stages to prepare the material for the rewinding operation. The material may be passed through small diameter bending rolls 10 to break away insulation material which has become affixed to the surfaces of the material 6. This step is accomplished by bending material 6 about rollers 10 which has such small diameters that the insulation which is formed of composition or some other type of paper will break away from the surface since it does not have the same bending characteristics as the material. The material may then pass to a brush station such as reversely rotating cylindrical wire brushes 12. These brushes extend across the entire surface of the two sides of material 6 and rotate in an opposite direction with respect thereto to scrape away remaining insulation material and other contaminants from the surface. The material 6 may then pass to an abrasion station such as abrasion devices 14. In this embodiment the abrasion devices are shown as 2 vertically displaced cylindrical groupings of abrasion surfaces such as sandpaper or the like which rotate in an opposite direction with respect to the movement of material 6 and deburr and resurface the edges of both sides of material 6. The material 6 may also be passed through a straigtening means such as roller group 16 wherein the material 6 is passed over a plurality of rollers of various selectable diameters and displacements with respect to one another to pull and bend the material 6 into its proper original geometric form. This straightening step is particularly applicable to aluminum metallic strip material which can be easily formed. From the straightening station, the material can be rewound by winding turntable 8 onto roll 18. To form the coil into its final form, insulation material 20 can be fed from an insulation supply roll 22 such that a layer of insulation material is placed between each layer of metallic strip material and the next succeeding layer of metallic strip material. In this manner, the final form of the electromagnetic field generating coil structure is achieved.

In this embodiment of the present invention, a drive means 24 is shown in FIG. 1 as transmitting rotational torque to fly-wheel 26 through drive belt 28. Drive means 24 can be any conventional type motor means. Conventional fly wheel 26 can convey the torque to the turntable 8 through any standard gearing arrangement located within base 30 of the rewinding turntable structure. Such common gear configurations as a standard ring and pinion system would be directly useful. In this manner rotational torque from drive means 24 is conveyed to rewinding turntable 8. Positioned upon rewinding turntable 8 can be a spool means 32 which is fixedly attached to the top surface of rewinding table 8. In this manner when material 6 is attached to spool 32 the material will start to be pulled through the processing system from the roll 4 on payoff table 2. In this manner the various processing steps between the original coil and the newly formed final coil will be able to operate upon the metallic strip material passing therethrough.

The speed of passage of material 6 through the processing system can be varied by the output of drive means 24 or by the change of gearing by a transmission or the like within base 30 of rewinding turntable 8. It should be appreciated that the variation in the drive means exerted upon the material 6 will provide great variations in the tension exerted between the sharp bending angles of bending rolls 10 and straighten roll 16. Another manner of controlling the tension and speed of movement of material 6 is by a braking means 34 which is adapted to vary the rotational resistance of payoff table 2. This can be accomplished by providing a frictional drag directly on payoff table 2 or by providing a frictional drag on a rotating shaft attached thereto such as shaft 36. By these various controls the speed and tension of material 6 while passing through the processing system can be selectively and accurately controlled.

The particular processing stations to which the material 6 will be subjected will vary in accordance with the exact condition of the roll 4 when received from the field. Usually roll 4 will be shorted to the extent that various contaminants will be providing electrical flow directly from one layer of conductor material to the next layer of conductor material. Other problems existing in these shorted rolls will include the break down of the insulating material between adjacent coil layers. Further problems will include the strong adherence of the insulation material to the surfaces of material 6 since during operation roll 4 will be subjected to extremely high temperatures especially during the period of time immediately prior to being fully shorted. During this time the frictional resistance and heat generated will be great. In this manner the insulation material will burn on and strongly adherent to both surfaces of material 6. Often the insulation will adhere to strip material 6 in large sheets due to being burned on. To remove this material the first station will preferably include bending rolls 10.

Figure 2:
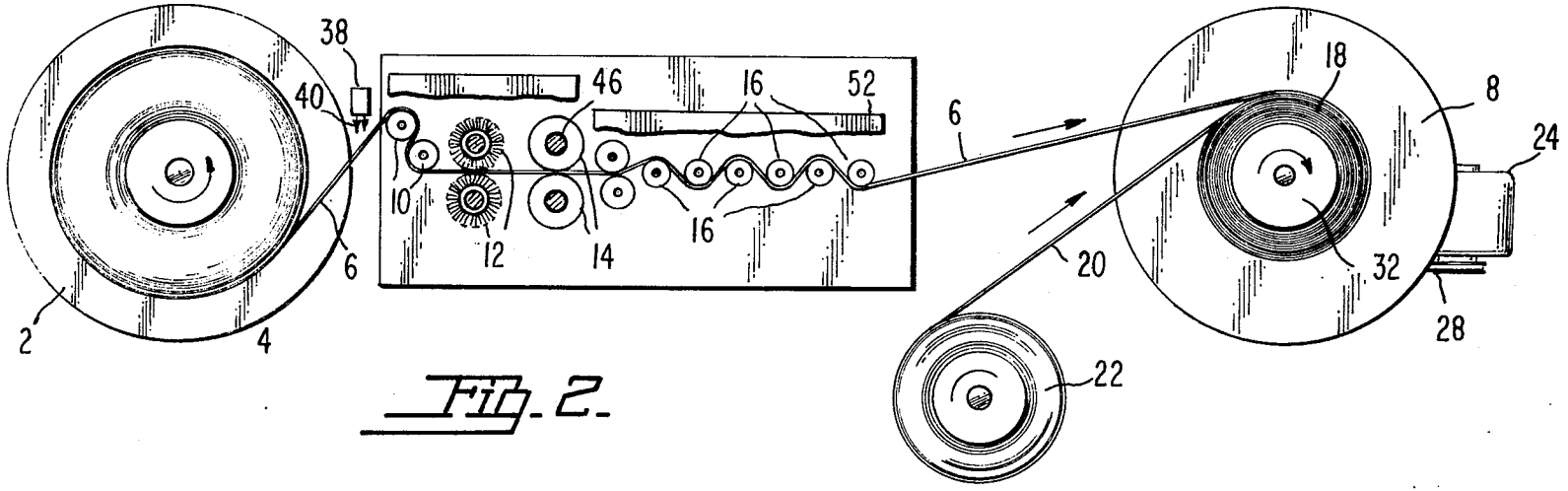

The nature of the bending rolls station will be to form the materials 6 tightly about sharp bending radii. The bending of the strip material 6 itself will be easily accomplished since it is a metallic substance and especially if it is aluminum. However the ability of the brittle composition or paper insulation material to bend is greatly limited. In order to break away the insulation material from both sides of strip material 6 the metallic strip material should be bent around bending rollers in both directions as shown in FIG. 2. In this manner the insulation material breaks from the surface of the strip material 6 which is not in contact with the roller since it is that surface which is being slightly stretched and thus brakes the adherence of the insulation material burned thereon. The insulation material will be much more brittle if it passes through bending rolls 10 in a dry condition. If the insulation material is dry it will therefore be more brittle and more easily will break away from the surfaces of metallic strip material 6. To achieve this dry characteristic of the insulation material a drying station such as blower 38 can be positioned immediately prior to bending station 10 such that hot air as shown blowing in the direction of arrows 40 can heat and thereby dry any insulation material adhering to metallic strip material 6. Additionally rollers 10 can be freely rotatable or can be chosen to be fixed. In either configuration the desired high angle of bending can be achieved.

Another step in this embodiment of the present invention includes the brushing station utilizing wire brushes 12. A drive means 42 is positioned above cylindrical wire brushes 12 such that they may be rotated in the opposite direction to the movement material 6. Brushes 12 are positioned having their outer circumference in contact such that the material 6 may pass tangentially in between the rollers 12 while the outer circumference of the cylindrical wire brushes will move oppositely with respect to material 6 to scrap therefrom various contaminants. The contaminants to which this station is particularly directed are remaining traces of insulation material and sealing compound which can be used to attach the insulation material to the surfaces of the metallic strip material. To achieve this purpose cylindrical wire brushes 12 extend across the entire two lateral sides of metallic strip material 6.

The present invention may also include an abrasion station which includes abrasion devices 14. These devices may be driven by a drive means 44. In the present embodiment of the present invention the abrasion devices include a plurality of sheets of material having grit embedded therein such as sandpaper. These sheets of abrasion material extend outward from a drive shaft 46 which is driven by drive means 44. The abrasion surfaces extend outward radially from drive shaft 46 and maybe selectively located along the positions where the edges of material 6 will pass by this station. In this manner the abrasion devices 14 may be rotationally driven in an opposite direction to the movement of material 6 such that as material 6 passes therebetween the edges of material 6 will be cleaned and deburred to recondition the metallic strip material for rewinding. Burrs must be removed for a variety of reasons including the localization of intense heat which would be created in the direct neighborhood of any metallic imperfection in the strip material 6.

After the previously described steps in the present process have operated upon the strip material 6 the surfaces of the material will be in condition for rewinding. However the material itself must be reshaped such that the sides are flat and unwavy and the edges are straight without distortion. To achieve this overall desired geometry of material a roller bank 16 contains therein a plurality of freely rotatable rollers 48 positioned immediately prior to the rewinding station. These rollers will cause material 6 to be bent around various radii of curvature at various tensions to achieve the overall desired geometry. The tension between adjacent rollers is variable by controlling the amount of force exerted by the pull of rewinding turntable 8. The greater the force exerted by turntable 8 on the material 6 while within roller group 16 the greater will be the stretching and bending of material 6 about roller 16. This tension can again be varied in accordance with the condition of the material after the surfaces have been cleaned and it is ready for straightening. The rollers 48 can be positioned between table 50 and upper platform 52 such that a variety of positioning holes is available in which rollers 48 of roller group 16 can be positioned. In this manner the degree of bending can be varied as well as the tension between adjacent rollers.

After processing, the metallic strip material or aluminum strip material 6 will be ready for rewinding onto spool 32. If it is desired that the winding made upon turntable 8 will be the final coil winding, it will be desirable to apply insulation 20 from insulation supply roll 22. This step can be achieved simply by placing an insulation supply roll 22 in the immediate area of rewinding turntable 8 and attaching the leading edge of insulation 20 to the spool 32 such that as the material 6 is rewound, the insulation 20 will be placed between adjacent layers of metallic strip material to form the desired final rolled electromagnetic coil configuration. The insulation 20 as it is applied between adjacent layers of material 6 can have a potting compound or other gluing material on the surfaces thereof to facilitate contact between the insulation 20 and the metallic strip material 6.

While particular embodiments of this invention have been shown in the drawings and described above, it will be apparent that many changes may be made in the form, arrangement and positioning of the various elements of the combination. In consideration, thereof, it should be understood that preferred embodiments of this invention disclosed therein are intended to be illustrative only and not intended to limit the scope of the invention.

I claim:

1. Apparatus for processing metallic strip material comprising:

a. feed means for supplying unprocessed metallic strip material;

b. bending means for forming the strip material about small bending angles;

c. brush means for stripping the surfaces and edges of the strip material;

d. abrasion means for scraping undesired substances from the sides and edges of the strip material;

e. straighten means for stretching and pulling the strip material to flatten and straighten all sides, edges and surfaces thereof; and f. rewinding means for receiving fully processed strip material; and g. insulation supply means to supply a layer of insulation material to the fully processed metallic strip material received by said winding means.

2. The apparatus as defined in claim 1 wherein said rewinding means comprises:

a. a rotatably mounted winding turntable having metallic strip material secured thereto;

b. a drive shaft affixed to said winding turn-table; and c. drive means connected to said drive shaft to drive said winding turntable and pull the metallic strip material through the processing apparatus.

3. The apparatus as defined in claim 2 wherein said rewinding means includes a spool mounted to said winding turntable, said spool being secured to the fully processed metallic strip material to allow the strip material to wind around the spool in a cylindrical manner subsequent to processing.

4. The apparatus as defined in claim 1 wherein said feed means comprises:

a. a rotatably mounted payoff turntable having located thereon a roll of unprocessed metallic strip material; and b. an adjustable brake means for controlling the magnitude of frictional drag resistant to rotation of said payoff turntable to control the supply of unprocessed strip material and the tension on the strip material throughout the processing apparatus.

5. The apparatus as defined in claim 1 wherein said bending means includes at least one cylindrical roller about which the metallic strip material passes to break away any material on the surface of the strip material having different bending properties than the strip material.

6. The apparatus as defined in claim 5 wherein said bending means includes two rollers having radii less than the width of the strip material and positioned adjacent one another.

7. The apparatus as defined in claim 1 wherein said brush means includes cylindrical wire brushes abutting both sides of the metallic strip material.

8. The apparatus as defined in claim 1 wherein said brush means is positioned in abuttment with respect to the strip material and moves in a direction opposite the direction of movement of the strip material.

9. The apparatus as defined in claim 1 wherein said abrasion means is positioned in contact with the moving strip material and moves oppositely with respect thereto.

10. The apparatus as defined in claim 1 wherein said abrasion means includes two cylindrical peripherally spaced sections which contact the edges of the strip material.

11. The apparatus as defined in claim 1 wherein said abrasion means includes leaf sections having grit embedded therein for scraping foreign matter and burrs from the surfaces and edges of the metallic strip material.

12. The apparatus as defined in claim 1 wherein said straighten means includes a plurality of rollers.

13. The apparatus as defined in claim 12 wherein said rollers are freely rotatable.

14. The apparatus as defined in claim 13 wherein said straighten means includes adjustable positioning devices for said rollers.

15. A method for processing metallic strip material comprising:

a. feeding unprocessed metallic strip material;

b. bending metallic strip material about small bending diameters to free material from the surfaces thereof;

c. brushing the surfaces of the metallic strip material to strip away foreign substances;

d. scraping the surface of the metallic strip material with abrasion surfaces to remove undesired substances therefrom;

e. straightening and flattening the metallic strip material including all sides, surfaces, and edges; and f. winding the fully processed strip material; and g. applying a layer of insulation material between circumferential layers of metallic strip material.

16. The method as defined in claim 15 wherein said bending includes forming the strip material about freely rotatable rollers having diameters smaller than the width of the strip material.

17. The method as defined in claim 15 wherein said brushing is performed using wire brushes.

18. The method as defined in claim 15 wherein said scraping is performed using grit embedded leaves.

19. The method as defined in claim 16 wherein said winding includes driving a winding turntable to wind and pull metallic strip material through the processing apparatus.

20. The method as defined in claim 15 wherein said feeding comes from a rotatably mounted payoff turntable which rotates to supply strip material from a coil of unprocessed metallic strip material.

21. The method as defined in claim 15 further comprising braking of said feeding to control the supplying of unprocessed strip material.

22. The method as defined in claim 15 wherein said brushing includes brushing each side surface of the strip material with the rotating cylindrical wire brushes.

23. The method as defined in claim 15 wherein said brushing includes moving the brushing means in a direction opposite to the direction of movement of the strip material.

24. The method as defined in claim 15 wherein said scraping includes moving the abrasion means in the direction opposite the direction of movement of the metallic strip material.

25. The method as defined in claim 15 wherein said straightening includes passing the metallic strip material over a plurality of rollers.

* * * * *